United States Patent [19]

Phillips et al.

[11] 4,273,202

[45] Jun. 16, 1981

[54] DRILLING BIT FOR BLAST FURNACE TAP HOLES

[75] Inventors: Paul S. Phillips, Pittsburgh; Glenn Forsythe, Ellwood City, both of Pa.

[73] Assignee: Woodings Industrial Corporation, Mars, Pa.

[21] Appl. No.: 8,993

[22] Filed: Feb. 5, 1979

[51] Int. Cl.[3] ..... E21B 10/00

[52] U.S. Cl. ..... 175/385; 175/415; 175/418

[58] Field of Search ..... 175/20, 393, 389, 398, 175/399, 400, 410, 415, 418, 419, 421, 422, 385, 386, 390, 106, 420, 416, 417, 391; 405/248

[56] References Cited

U.S. PATENT DOCUMENTS

| | | | |
|---|---|---|---|
| 2,013,070 | 9/1935 | Sheridan | 175/106 X |
| 2,016,068 | 10/1935 | Bannister | 175/106 X |
| 2,022,101 | 11/1935 | Wright | 175/404 X |
| 2,028,580 | 1/1936 | Yedd | 175/393 X |
| 2,673,716 | 3/1954 | Avery | 175/410 |
| 2,756,967 | 7/1956 | Meutsch | 175/415 X |
| 2,802,642 | 8/1957 | Feucht | 175/419 X |
| 3,163,246 | 12/1964 | Vagins et al. | 175/415 X |

*Primary Examiner*—James A. Leppink
*Assistant Examiner*—Richard E. Favreau
*Attorney, Agent, or Firm*—Thomas H. Murray

[57] ABSTRACT

A drilling bit for blast furnace tap holes and the like which facilitates rapid drilling of clay within the tap hole and which can be readily and easily machined to accommodate tap holes of different diameters. The bit is characterized in having inclined cutting edges which converge into a point and are separated by flutes into which compressed air is forced to rapidly dislodge the drilled clay from between the cutting edges. By virtue of the convergence of the cutting edges into a point, the bit becomes self-centering during the drilling operation.

5 Claims, 4 Drawing Figures

DRILLING BIT FOR BLAST FURNACE TAP HOLES

BACKGROUND OF THE INVENTION

As is known, the hearth of a blast furnace is provided with an iron notch or tap hole through which molten iron is drawn off periodically—usually four or five times a day. The tap hole is plugged with clay or mud at all times except when the furnace is casting (i.e., except when the molten iron is withdrawn). When it is desired to tap the blast furnace, a pneumatic drill is used to drill into the clay to form an opening for the molten iron to be tapped.

The tap hole itself may be 5 to 9 feet long; and with presently-used drill bits, the time required to drill through the clay may be as high as 20 minutes, particularly in the case where the harder anhydrous clays are used. This is disadvantageous in a blast furnace operation where charging and tapping must be scheduled more or less precisely and where any delays are reflected as a loss in tonnage.

SUMMARY OF THE INVENTION

In accordance with the present invention, a new and improved drill bit is provided for blast furnace tap holes and the like which materially decreases the time to drill the hole, thereby facilitating blast furnace scheduling and minimizing losses in tonnage due to delays in drilling the tap hole.

Specifically, the drilling bit of the invention comprises a central, generally-cylindrical body portion having an opening for receiving the end of a hollow drill rod and provided with flanged cutting elements mounted on the cylindrical body portion at right angles to its central axis. The cutting elements are separated by flutes and have outer inclined cutting edges which extend beyond the periphery of the cylindrical body portion at their points of connection thereto and converge into a point at the forward end of the bit opposite the cylindrical body portion. Passageways are provided in the body portion for conveying fluid, preferably compressed air, from the hollow drill rod into the flutes to force drilled material backwardly and away from the bit as it is forced into material being drilled.

In the preferred embodiment of the invention, the inclined cutting edges of the flanged cutting elements are straight along the major portions of their lengths but terminate at their ends opposite the forward end of the bit in radially-outwardly curved portions. In this manner, the radially-outwardly curved portions may be machined away to reduce the effective diameter of the drill bit without affecting the cutting edges on the flanged cutting elements themselves.

The above and other objects and features of the invention will become apparent from the following detailed description taken in connection with the accompanying drawings which form a part of this specification, and in which.

Figure 1:
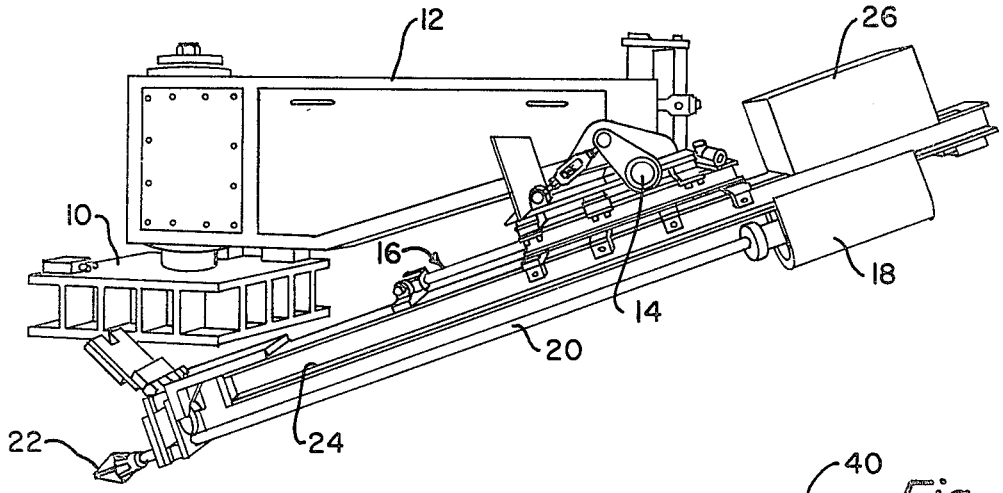
FIG. 1 is a perspective view of one type of tap hole drill with which the drilling bit of the invention may be used.

With reference now to the drawings, and particularly to FIG. 1, the tap hole drill shown includes a base 10 on which is mounted an arm 12 for pivotal movement about a vertical axis. Carried on the outer extremity of the arm 12 is a shaft 14 on which is mounted the drill assembly 16 itself. The drill assembly 16 includes a rotary air motor 18 connected to a drill rod 20 which carries at its forward end a drill bit 22. The rotary air motor 18 is mounted on a track 24 by means of rollers such that the air motor 18, the drill rod 20 and the drill bit 22 can be advanced into the tap hole or retracted. The rotary air motor 18 is connected to a continuous chain which passes around sprockets, not shown, at opposite ends of the track 24 and is driven by means of an air motor 26 mounted on top of the drill assembly 16.

In the operation of the tap hole drill, the drill assembly 16, which is at an angle corresponding to the angle of the tap hole, is swung into position by the pivoted arm 12. Thereafter, the rotary air motor 18, drill rod 20 and bit 22 are advanced into the tap hole with the bit 22 rotating to remove the plugging clay or mud from the tap hole such that molten iron can flow therethrough. As the drilling bit 22 advances into the tap hole, compressed air is forced through a bore in the drill rod 20 and through openings in the drilling bit 22, about to be described, such that the drilled material may be blown backwardly through the tap hole.

Figure 3:
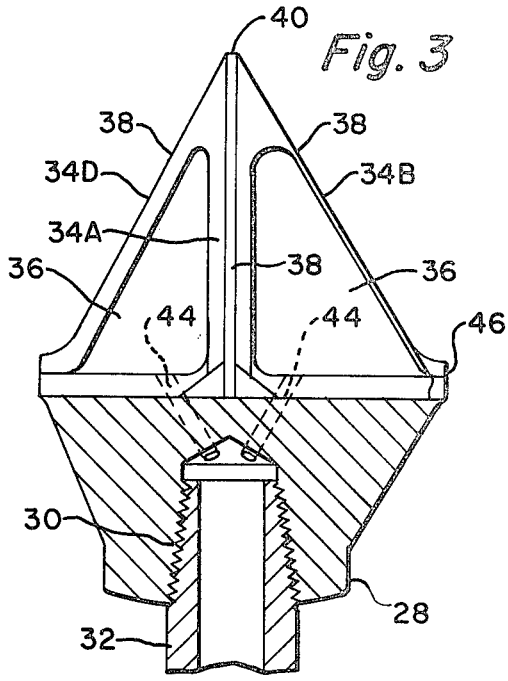
FIG. 3 is a partially broken-away cross-sectional view, similar to FIG. 2, but showing the manner in which a fluid is conveyed to the flutes between flanged cutting elements.
Figure 2:
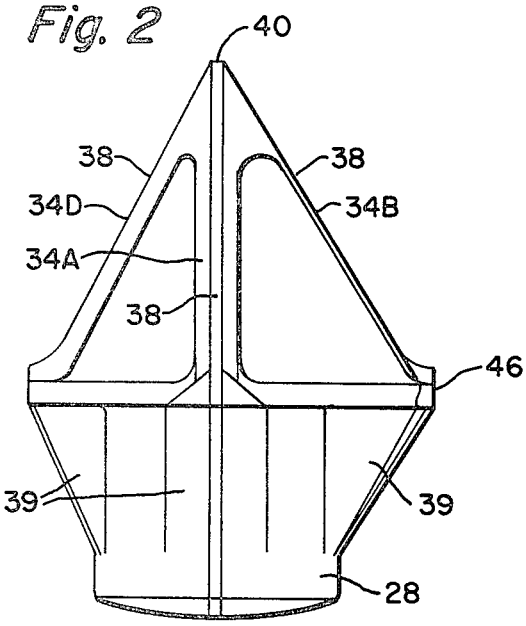
FIG. 2 is an elevational view of the drilling bit of the invention.
Figure 4:
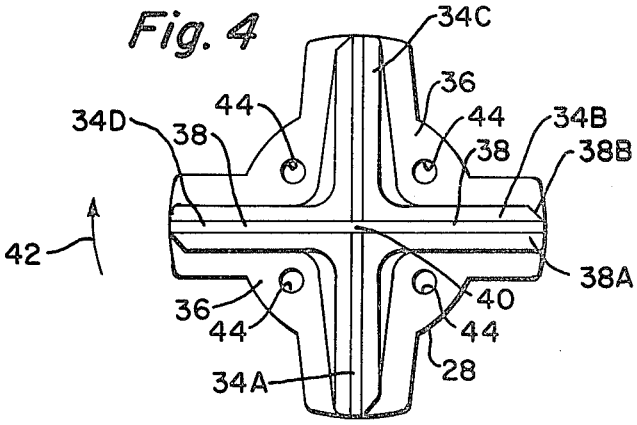
FIG. 4 is a top view of the drilling bit of the invention.

The improved drilling bit of the invention is shown in FIGS. 2–4 and comprises a generally cylindrical body portion 28 having a threaded opening 30 (FIG. 3) for receiving the end of a hollow drill rod 32. Carried at the forward end of the cylindrical body portion 28 are four flanged cutting elements 34A–34D extending radially outwardly from the central axis of the cylindrical body portion 28. Beneath each cutting element, and projecting outwardly from the central body portion 28 are integral supporting flanges 39 (FIG. 2). In-between the flanged cutting elements 34A–34D are fluted portions 36 within which the clay or mud collects during a drilling operation. The flanged cutting elements 34A–34D have outer inclined cutting edges 38 which extend beyond the periphery of the cylindrical body portion at their points of connection thereto. These inclined cutting edges converge into a point 40 to form a spear-like configuration for the drilling bit.

The direction of rotation of the bit during a drilling operation is indicated by the arrow 42 in FIG. 4. Note that the cutting edges 38 are divided into a forward edge 38A facing in the direction of rotation of the bit and a trailing edge 38B. The trailing edge on each cutting edge is inclined at a greater angle than the forward edge to facilitate the removal of the drilled material. Preferably, the trailing edge is inclined at an angle of 45° with respect to a plane extending through each flanged cutting element while the leading edge is inclined at an angle of 80° with respect to the aforesaid plane.

Extending through the cylindrical body portion 28 and communicating with each of the fluted portions 36 are bores 44 (FIGS. 3 and 4) which connect with the opening 30 into which the drill rod 32 is threaded and, consequently, communicate with the interior of the hollow drill rod 32. Compressed air is forced through the hollow drill rod and through the holes 44 to dislodge drilled material and force it backwardly through the drilled tap hole.

During a drilling operation, the bit is both rotated and reciprocated in a hammering motion. By virtue of this unique configuration, its speed of penetration is greatly increased over conventional drills such that the time required for drilling the tapping hole can be decreased from 20 minutes to as little as 1 minute or less. At the same time, and in contrast to conventional bits, the pointed nature of the bit makes it self-aligning during the drilling operation.

It will be noted that the lower end of the cutting edges 38 are curved radially outwardly as at 46 in FIG. 2. With this arrangement, a single die can be used to forge all of the bits, but bits for various diameter tap holes can be achieved by simply milling away a portion of the area at 46.

Although the invention has been shown in connection with a certain specific embodiment, it will be readily apparent to those skilled in the art that various changes in form and arrangement of parts may be made to suit requirements without departing from the spirit and scope of the invention.

We claim as our invention:

1. A drilling bit comprising a central, generally cylindrical body portion having an opening for receiving the end of a hollow drill rod, flanged cutting elements mounted on said cylindrical body portion and extending radially outwardly from its central axis, the cutting elements being separated by flutes and having outer inclined cutting edges which extend beyond the periphery of the cylindrical body portion at their points of connection thereto and which converge into a point at the forward end of the bit opposite the cylindrical body portion, the body portion and the cutting elements being formed from a single, integral forging, and passageways in said body portion for conveying fluid into said flutes to force drilled material backwardly and away from said bit as it is forced into the material being drilled.

2. The drilling bit of claim 1 including radial flanges between said central body portion and the ends of said flanged cutting elements opposite the forward end of the drill bit.

3. The drilling bit of claim 1 wherein said cutting edges have a forward edge facing in the direction of rotation of the bit and a trailing edge, the forward edge being inclined with respect to a central radial plane extending through an associated cutting element at a greater angle than the trailing edge.

4. The drilling bit of claim 3 wherein said forward edge of each cutting edge is inclined at an angle of about 80° with respect to said central plane and the trailing edge is inclined at an angle with respect to said central plane of about 45°.

5. A drilling bit comprising a central, generally cylindrical body portion having an opening for receiving the end of a hollow drill rod, flanged cutting elements mounted on said cylindrical body portion and extending radially outwardly from its central axis, the cutting elements being separated by flutes and having outer inclined cutting edges which extend beyond the periphery of the cylindrical body portion at their points of connection thereto and which converge into a point at the forward end of the bit opposite the cylindrical body portion, said inclined cutting edges being straight along the major portions of their lengths and terminating at their ends opposite said forward point in radially-outwardly curved portions, and passageways in said body portion for conveying a fluid into said flutes to force drilled material backwardly and away from said bit as it is forced into the material being drilled.

* * * * *